US011814254B2

(12) United States Patent
Ollé

(10) Patent No.: US 11,814,254 B2
(45) Date of Patent: Nov. 14, 2023

(54) DIE-CUTTING MACHINE COMPRISING A TRANSPORT SYSTEM CONFIGURED AS A CHAIN GRIPPER SYSTEM AND METHOD FOR OPENING AT LEAST ONE HOLDING ELEMENT

(71) Applicant: KOENIG & BAUER AG, Würzburg (DE)

(72) Inventor: Sergi Ollé, El Prat de Llobregat (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/642,247

(22) PCT Filed: Oct. 15, 2020

(86) PCT No.: PCT/EP2020/079035
§ 371 (c)(1),
(2) Date: Mar. 11, 2022

(87) PCT Pub. No.: WO2021/083677
PCT Pub. Date: May 6, 2021

(65) Prior Publication Data

US 2022/0315371 A1 Oct. 6, 2022

(30) Foreign Application Priority Data

Oct. 28, 2019 (DE) ..... 10 2019 128 983.1

(51) Int. Cl.
*B65H 29/04* (2006.01)

(52) U.S. Cl.
CPC ..... *B65H 29/047* (2013.01); *B65H 29/041* (2013.01); *B65H 29/044* (2013.01); *B65H 2801/42* (2013.01)

(58) Field of Classification Search
CPC .. B65H 29/047; B65H 29/041; B65H 29/044; B65H 29/048; B65H 29/04; B65H 2801/42
See application file for complete search history.

(56) References Cited

U.S. PATENT DOCUMENTS 3,109,644 A * 11/1963 Reinartz ..... B65H 29/047 271/206
3,610,579 A * 10/1971 Jiruse ..... B65H 29/28 271/206

(Continued)

FOREIGN PATENT DOCUMENTS

CN 107223112 A 9/2017
CN 109071141 A 12/2018

(Continued)

OTHER PUBLICATIONS

Chinese Office Action received in corresponding Chinese Application No. 202080064137.7 dated Jul. 6, 2022.

(Continued)

*Primary Examiner* — Thomas A Morrison
(74) *Attorney, Agent, or Firm* — Mattingly & Malur, PC

(57) ABSTRACT

In some examples, a die-cutting machine includes a transport system configured as a chain gripper system. The chain gripper system includes a chain gripper carriage including a holding element for holding a sheet. The chain gripper carriage is arranged to be attached to at least one chain that is arranged to guide the chain gripper carriage on a guide path through at least part of the die-cutting machine. The chain gripper carriage includes a contact element functionally connected to the holding element. A chain gripper opener includes a contact surface at which, in the presence of the gripper carriage at the contact surface, the contact element cooperates with the chain gripper opener. The holding element is transferred at least from a closed position (Continued)

into an open position by cooperation of the chain gripper opener with the contact element. The chain gripper opener is adjustable by at least one drive.

15 Claims, 9 Drawing Sheets

(56) References Cited

U.S. PATENT DOCUMENTS

| | | | | |
|---|---|---|---|---|
| 4,205,606 | A * | 6/1980 | Jiruse | B65H 29/041 271/206 |
| 4,420,998 | A | 12/1983 | Tokuno et al. | |
| 5,351,946 | A | 10/1994 | Kamoda et al. | |
| 5,415,392 | A | 5/1995 | Maul et al. | |
| 2021/0122131 | A1* | 4/2021 | Chatry | B31B 50/142 |
| 2021/0122132 | A1* | 4/2021 | Ruchet | B31B 50/20 |

FOREIGN PATENT DOCUMENTS

| | | | |
|---|---|---|---|
| CN | 109311308 | A | 2/2019 |
| DE | 1141296 | B | 12/1962 |
| DE | 4209354 | A1 | 9/1993 |
| DE | 69307840 | T2 | 7/1997 |
| EP | 1867449 | A1 | 12/2007 |
| WO | 2018/197046 | A1 | 11/2018 |

OTHER PUBLICATIONS

International Search Report of PCT/EP2020/079035 dated Feb. 3, 2022.

* cited by examiner

DIE-CUTTING MACHINE COMPRISING A TRANSPORT SYSTEM CONFIGURED AS A CHAIN GRIPPER SYSTEM AND METHOD FOR OPENING AT LEAST ONE HOLDING ELEMENT

CROSS-REFERENCES TO RELATED APPLICATIONS

This application is the US national phase, under 35 USC § 371, of PCT/EP2020/079035, filed Oct. 15, 2020; published as WO 2021/083677 A1 on May 6, 2021, and claiming priority to DE 10 2019 128 983.1, filed Oct. 28, 2019, the disclosures of which are expressly incorporated by reference herein in their entireties.

TECHNICAL FIELD

The invention relates to a die-cutting machine comprising a transport system configured as a chain gripper system and to a method for opening at least one holding element. The die-cutting machine includes a transport system configured as a chain gripper system. The at least one chain gripper system includes at least one chain gripper carriage having at least one holding element for holding a sheet. The at least one chain gripper carriage is arranged so as to be attached to the at least one chain. The at least one chain is arranged so as to guide the at least one chain gripper carriage on a guide path through at least part of the die-cutting machine. The at least one chain gripper carriage includes at least one contact element that is functionally connected to the at least one holding element. The die-cutting machine includes at least one chain gripper opener that includes at least one contact surface at which, in the presence of the at least one gripper carriage at the at least one contact surface, the at least one contact element of the at least one chain gripper carriage is arranged so as to cooperate with the at least one chain gripper opener. The at least one holding element is arranged to be transferred at least from a closed position into an open position by way of the cooperation of the at least one chain gripper opener with the at least one contact element. The at least one chain gripper opener is arranged so as to be adjustable by means of at least one drive that is arranged so as to adjust the at least one chain gripper opener on a linear guide. The at least one contact surface (1226) includes at least one opening region at which the at least one holding element is arranged to start a transfer from a closed position into an open position. In some examples, the method for opening at least one holding element (1202) in a sheet processing machine (01) configured as a die-cutting machine (01), the die-cutting machine (01) comprising a transport system (1200), configured as a chain gripper system (1200), for transporting sheets (02) through at least part of the die-cutting machine (01), and at least one chain gripper carriage (1201) of the chain gripper system (1200) being attached to at least one chain (1203), the at least one chain gripper carriage (1201) being at least partially guided on a guide path (1230) through the die-cutting machine (01) by means of the at least one chain (1203), at least one contact element (1206) of the at least one chain gripper carriage (1201) cooperating on a portion of the guide path (1230) with at least one contact surface (1226) of at least one chain gripper opener (1217), and the at least one holding element (1202) being transferred at least from a closed position into an open position during the cooperation of the at least one contact element (1206) with the contact surface (1226) of the at least one chain gripper opener (1217), the at least one chain gripper opener (1217) being adjustable by means of at least one drive (1224), the at least one drive (1224) adjusting the at least one chain gripper opener (1217) on a linear guide (1219), the at least one contact surface (1226) including an opening region (1227), and the at least one holding element (1202) beginning to open during the cooperation of the contact element (1206) with the opening region (1227).

BACKGROUND

Web- or sheet-like materials are used in the production of packaging. For example, sheets are imprinted, embossed, creased, perforated, die-cut, cut, stitched, glued and, for example, folded into packaging in multiple processing steps. To optimally utilize the surface area of a sheet, in general multiple identical or different copies, for example of a poster, a folding box or a packaging, are printed on a common sheet and then die-cut. These copies are referred to as multiple-up copies.

A sheet processing machine can comprise different processing steps, such as imprinting, cutting, embossing, creasing, die cutting, perforating, gluing and/or stitching. Such sheet processing machines frequently also comprise inspection devices. Sheets are typically processed and cut to size in processing machines using tool-dependent die cutting and cutting devices.

Such a processing machine is configured as a die cutting, cutting, perforating, embossing and/or creasing machine, for example. When such a processing machine is referred to hereafter as a die cutter and/or a die-cutting machine, in particular also a cutting, perforating, embossing and/or creasing machine is meant. In addition to rotary die cutters, tool-dependent systems also encompass flat die cutters, in particular flat-bed die cutters. In these, multiple sheets are processed consecutively by a cyclically recurring movement. The sheets are preferably moved substantially horizontally through the processing machine by way of a transport system, preferably a chain gripper system. In addition to a die-cutting unit, such a machine usually also comprises other units, such as a sheet infeed unit, a sheet delivery unit, a stripping unit, a sheet insert unit, a multiple-up separating unit and an offcut piece delivery unit.

Such a sheet processing machine usually comprises a unit in which a sheet and/or an offcut piece are released by and/or detached from the chain gripper carriage. In particular, a chain gripper carriage comprises at least one holding element for this purpose. The at least one holding element releases the sheets and/or the offcut pieces in cooperation with a chain gripper opener.

A sheet-fed printing press comprising a transport system configured as a chain gripper system is known from DE 693 07 840 T2. The sheet-fed printing press comprises two delivery piles for stacking the processed sheets. The point in time at which the sheet is released can be set by adjusting a chain gripper opener. In particular, the position of the chain gripper opener is situated so as to be adjustable on a straight guide path.

A die-cutting machine comprising a chain gripper transport system is known from EP 1 867 449 A1. The die-cutting machine in particular comprises a chain gripper opener for releasing a sheet and/or an offcut piece. In particular, the chain gripper opener can be adjusted in a complex manner in the ejection station and/or the offcut piece removal unit by screwing it off and on.

DE 42 09 354 A1 discloses a sheet-fed printing press comprising a transport system, configured as a chain gripper system, for transporting the sheets through the machine. The chain gripper system comprises chain gripper carriages as well as multiple holding elements for holding a sheet. The patent specification furthermore discloses a chain gripper opener (cam segment) including a contact surface configured as an approach area. A control roller is transferred into an open position by the chain gripper opener. The chain gripper opener (cam segment) can be adjusted by a adjusting element.

WO 2018/197046 A1 discloses a device for ejecting sample sheets from a gripper bar of a transport device (chain gripper system) of a processing machine. The processing machine can be configured as a die cutter. The ejection device comprises an actuating element, which comprises a surface for opening the gripper bar. The profile of the actuating element is curved for this purpose, and the rotation driving element, upon contact, ensures opening of the gripper bar. The actuating element is transferred from an inactive position into an active position for the removal of a sample sheet. During production, the actuating element is in an active position. The angle of the profile of the actuating element can be varied for adaptation to the substrate. An actuator (drive) cooperates with the actuating element by way of a movement guidance means (linear guide).

DE 11 41 296 B relates to a gripper control unit at chain delivery systems of printing presses. The position of the gripper opening in the horizontal direction is controlled based on the machine speed, for example. The adjustment takes place by means of an electric motor.

U.S. Pat. No. 5,415,392 A discloses a device for controlling the grippers in a sheet-fed printing press. The sheets are deposited at different locations as a function of various parameters (e.g., substrate properties or machine speed). There are regions in which the guide path is not horizontally arranged. There, the gripper opener is adjustable on a guide that is adapted to the guide path of the chain gripper. As a result, mechanical stresses as well as noise and strikes on the gripper carriage are decreased.

U.S. Pat. No. 4,420,998 A discloses a die-cutting machine comprising chain gripper openers comprising opening regions. The opening angle can be varied in the process (adjustable angle).

SUMMARY

It is the object of the invention to create a die-cutting machine comprising a transport system configured as a chain gripper system and a method for opening at least one holding element.

The object is attained according to the invention by the chain gripper opener (1217) is arranged so as to be adjustable along a curved section of the guide path (1230) by way of the drive (1224) and the linear guide (1219), and that the at least one opening region (1227) has a distance (L1227) with respect to the guide path (1230), and that the at least one opening region (1227) is adjustable so as to be equidistant with respect to the guide path (1230). Further, in some examples, the method includes that the at least one chain gripper opener (1217) can be adjusted along a curved section of the guide path (1230) by means of the at least one drive (1224) and the linear guide (1219), and that the at least one opening region (1227) is adjusted so as to be equidistant with respect to the guide path (1230) by an adjustment of the at least one chain gripper opener (1217).

An advantage to be achieved with the invention is, in particular, is that an improved and easily adjustable chain gripper opener is created. By adjusting the chain gripper opener, the sheet and/or offcut piece release position can preferably be easily adjusted along a guide path and, as a result, the point in time at which the sheet is released during machine operation can be varied.

Another advantage to be achieved with the invention is that the chain gripper opener can be adjusted in a specific manner. In the process, the chain gripper opener can be adjusted along a guide path. In particular, the chain gripper opener can also be easily adjusted on a curved guide path. In particular, an opening region of a chain gripper opener can be adjusted so as to be equidistant with respect to the guide path, so that no stresses and/or loads arise in the machine. Furthermore, vibrations are prevented, and the maintenance complexity is reduced, by the equidistant adjustment. In particular, increased productivity can thus be achieved at higher machine speeds. For example, as a result of the increased productivity, the number of chain gripper carriages in the machine can be decreased from, for example, nine chain gripper carriages to eight chain gripper carriages.

Another advantage to be achieved with the invention is that a chain gripper opener can be adapted to various machine speeds and/or different substrate properties and/or different substrate formats and/or different offcut piece formats. For example, the chain gripper opener can be adjusted so as to open earlier at a high machine speed, and to open later at a lower machine speed. In particular, an accumulation and/or a jam of offcut pieces and/or sheets in the offcut piece discharge unit can thus be prevented.

Furthermore, the at least one chain gripper opener can be displaced as a function of the substrate format and/or the offcut piece format. In particular, for example, the sheet and/or the offcut piece, when being released from the chain gripper carriage, have various formats, depending on the upstream processing steps and/or number of multiple-ups. For example, by adjusting the position of the chain gripper opener, it is possible, for example, to vary and/or increase and/or improve the available space and the capacity for transporting away the sheets and/or the offcut pieces. In particular, a paper jam and/or an aggregation of sheets and/or offcut pieces can thus be avoided. In particular, various settings can be stored in a memory and, for example, can be automatically retrieved during a changeover of the sheet processing machine. Proceeding from this, the position of the chain gripper opener can be automatically adjusted.

The at least one chain gripper opener can be easily adjusted using a simple design solution. The at least one chain gripper opener can be adjusted along a guide. For this purpose, the chain gripper opener is in particular adjustable by means of a linear guide and a drive. In addition, the movability of the chain gripper opener is ensured by an articulated joint and a further linear guide.

BRIEF DESCRIPTION OF THE DRAWINGS

Exemplary embodiments of the invention are illustrated in the drawings and will be described in greater detail below. The drawings show.

DETAILED DESCRIPTION

Figure 1:
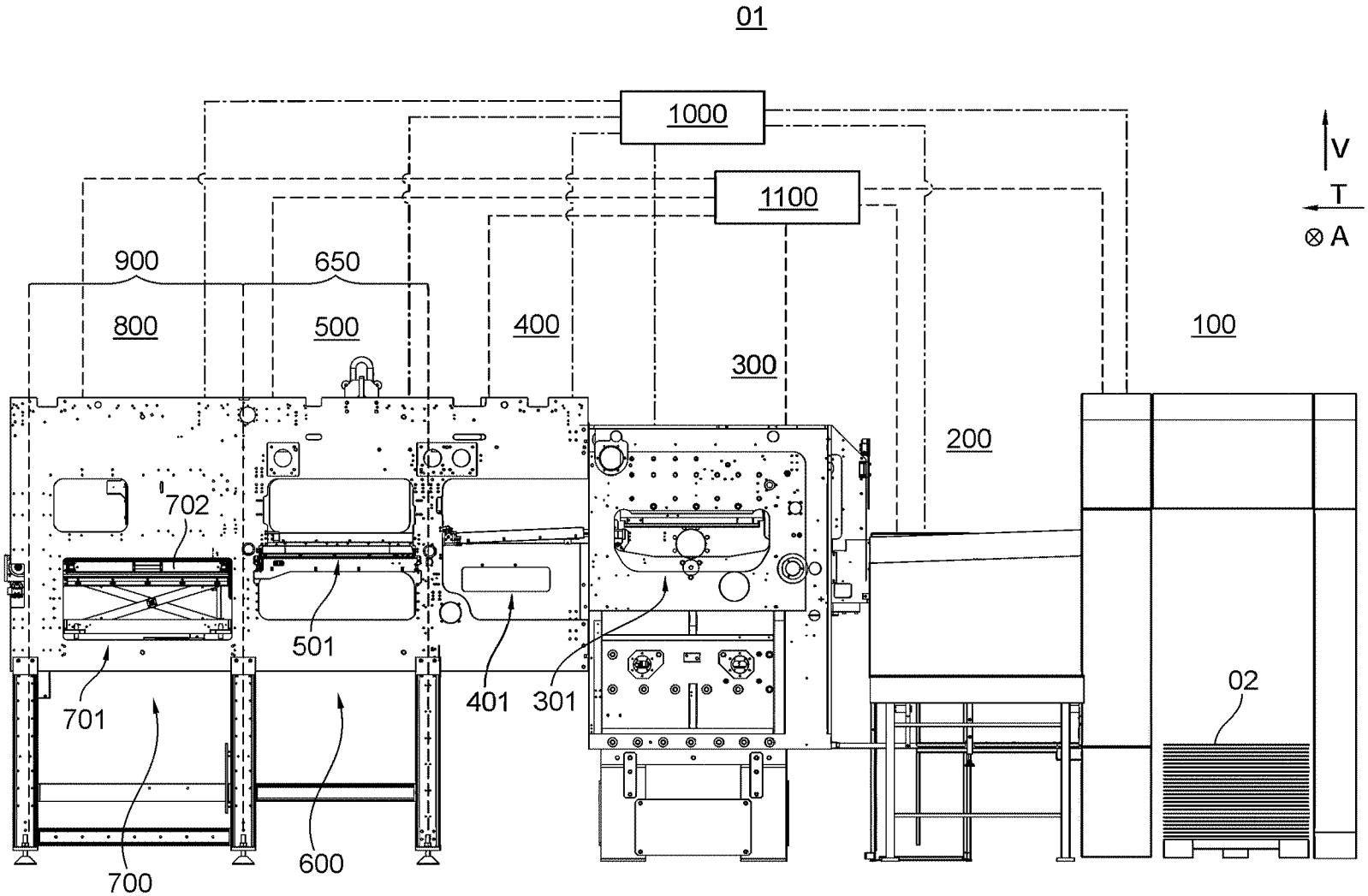
FIG. 1 an illustration of a sheet processing machine in a preferred embodiment in a side view.
Figure 2:
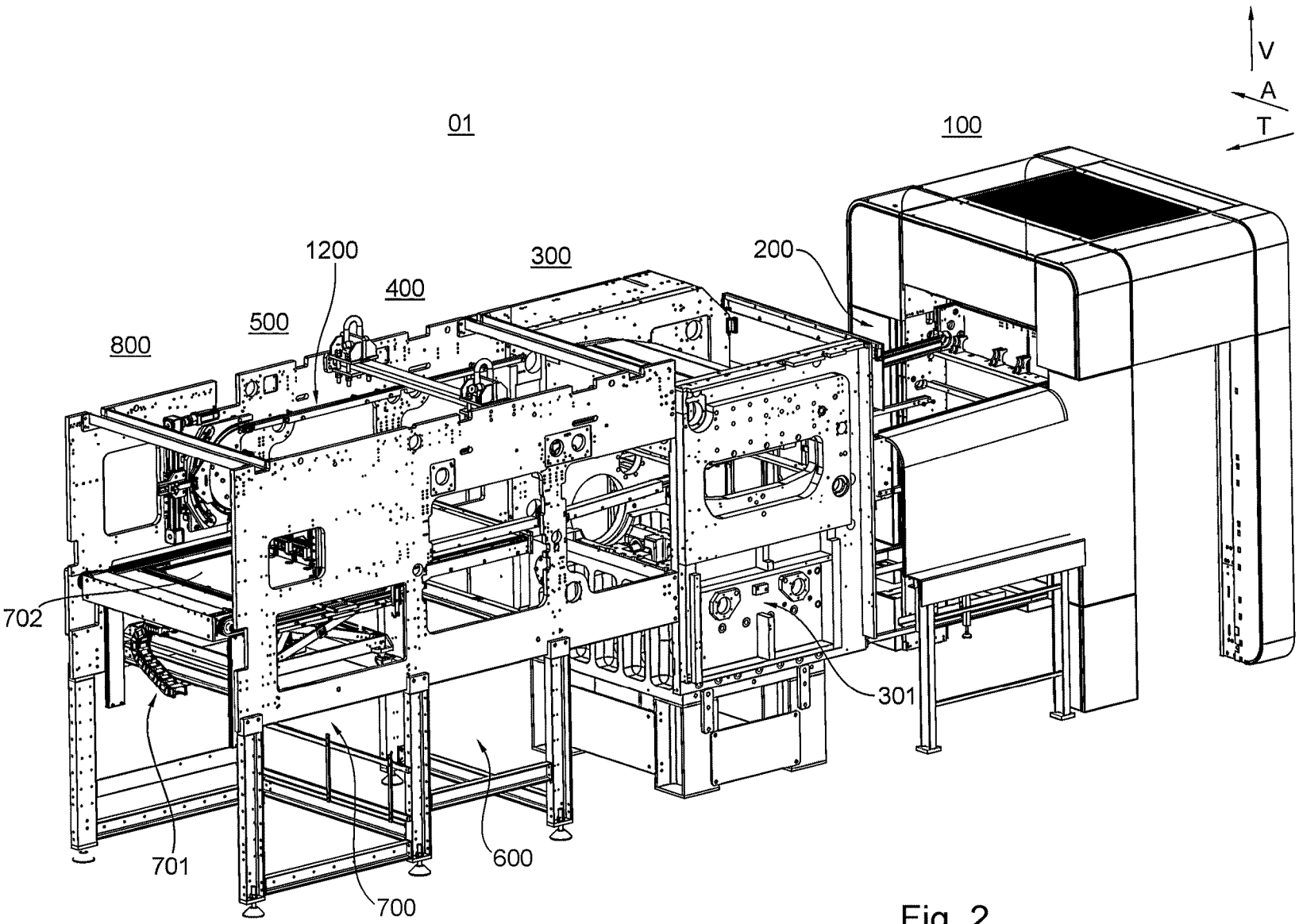
FIG. 2 a perspective illustration of the sheet processing machine in a preferred embodiment.
Figure 3:
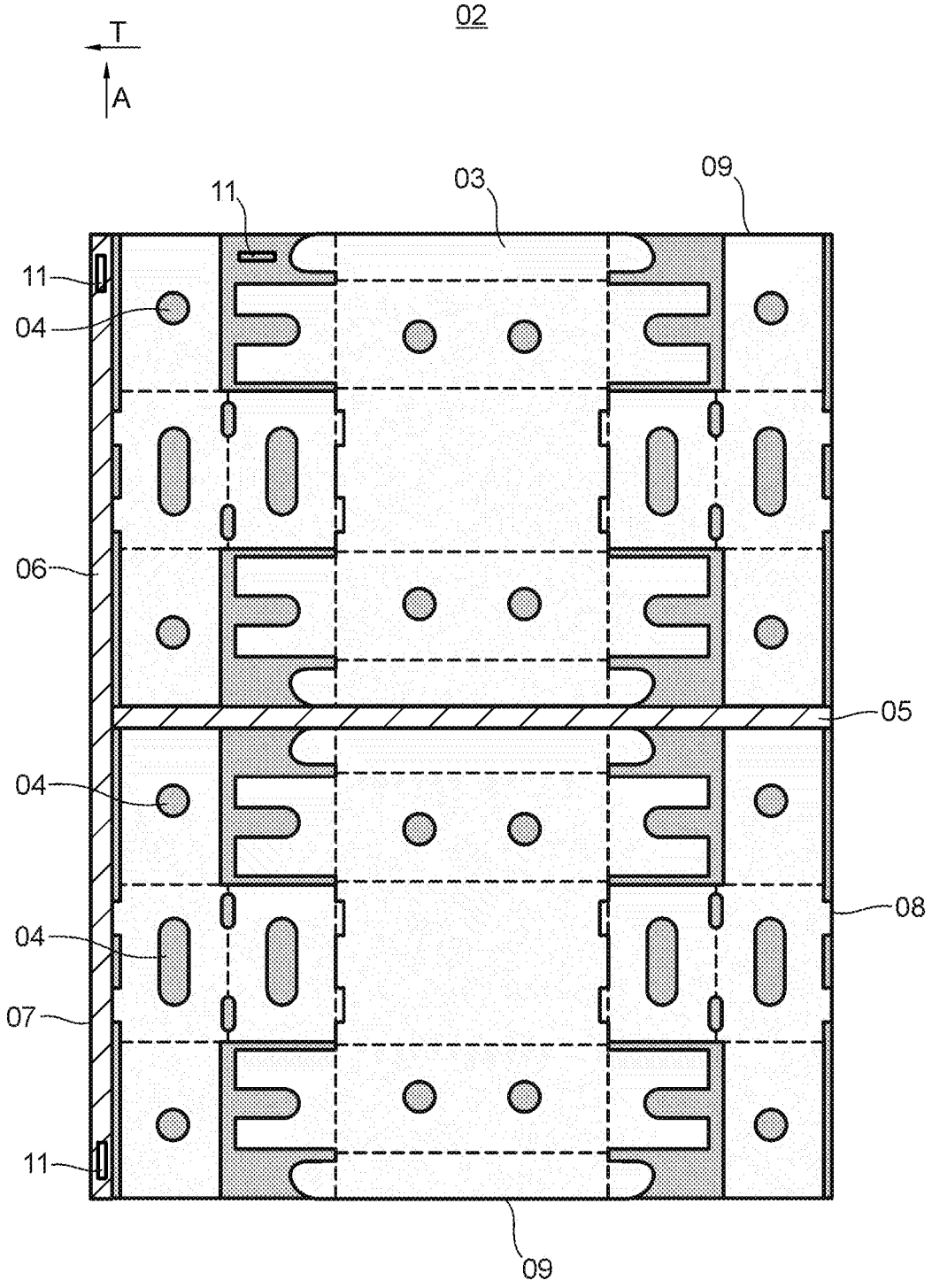
FIG. 3 a schematic illustration of a sheet and several multiple-up copies.
Figure 4:
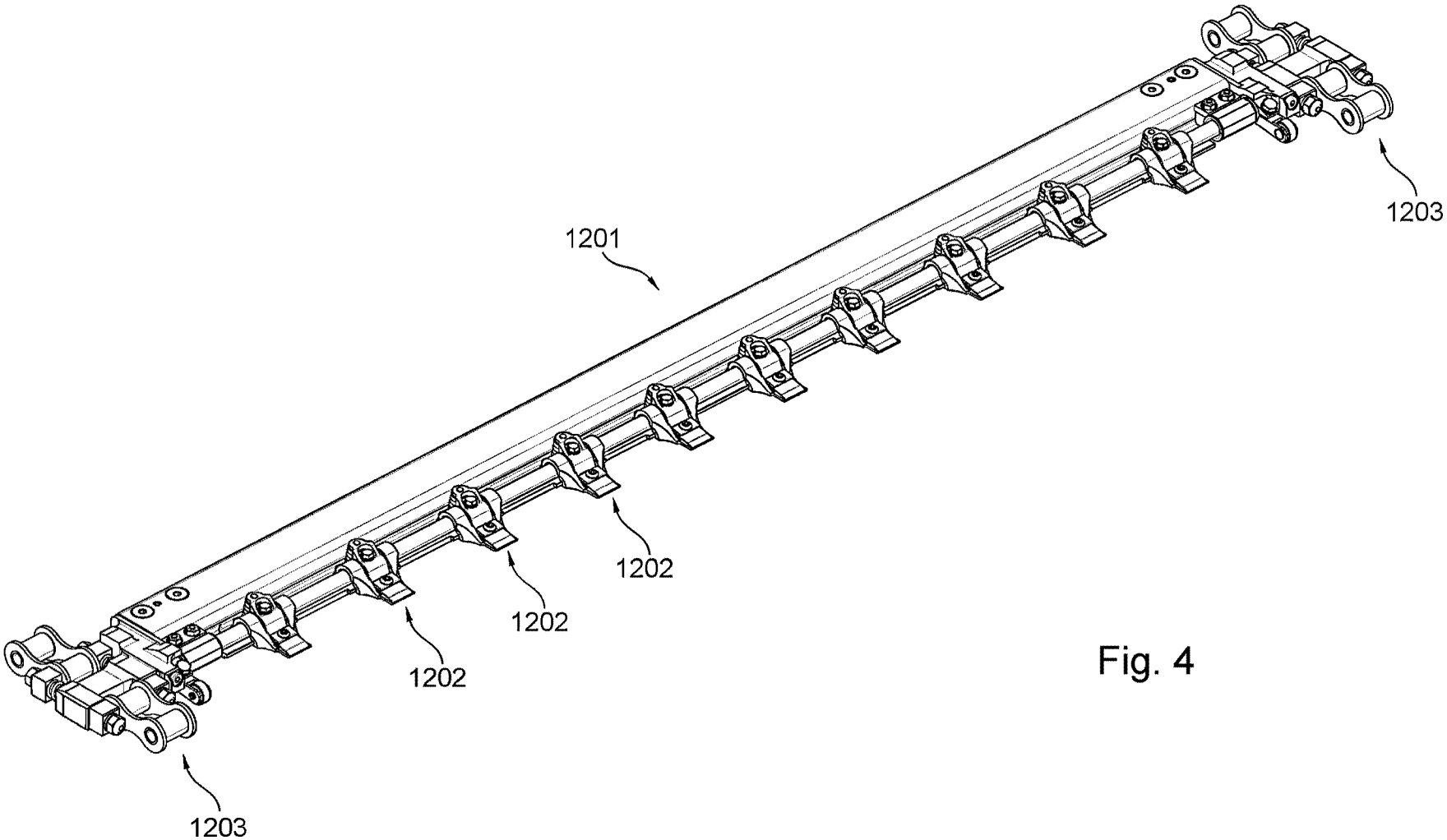
FIG. 4 a perspective illustration of a chain gripper carriage in a preferred embodiment.
Figure 5:
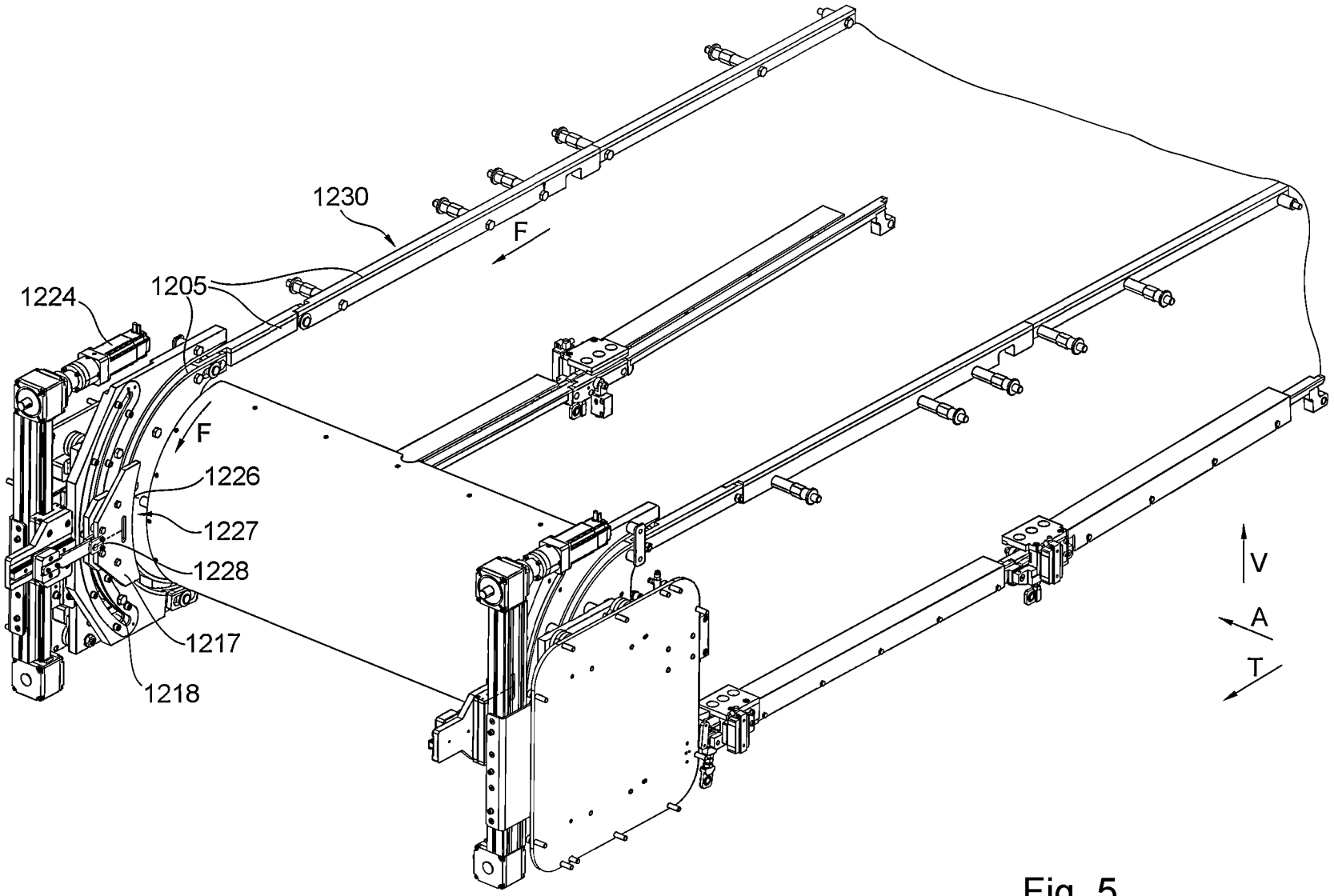
FIG. 5 a perspective illustration of the chain gripper opener and of the guide rail for guiding a chain in a preferred embodiment.
Figure 6:
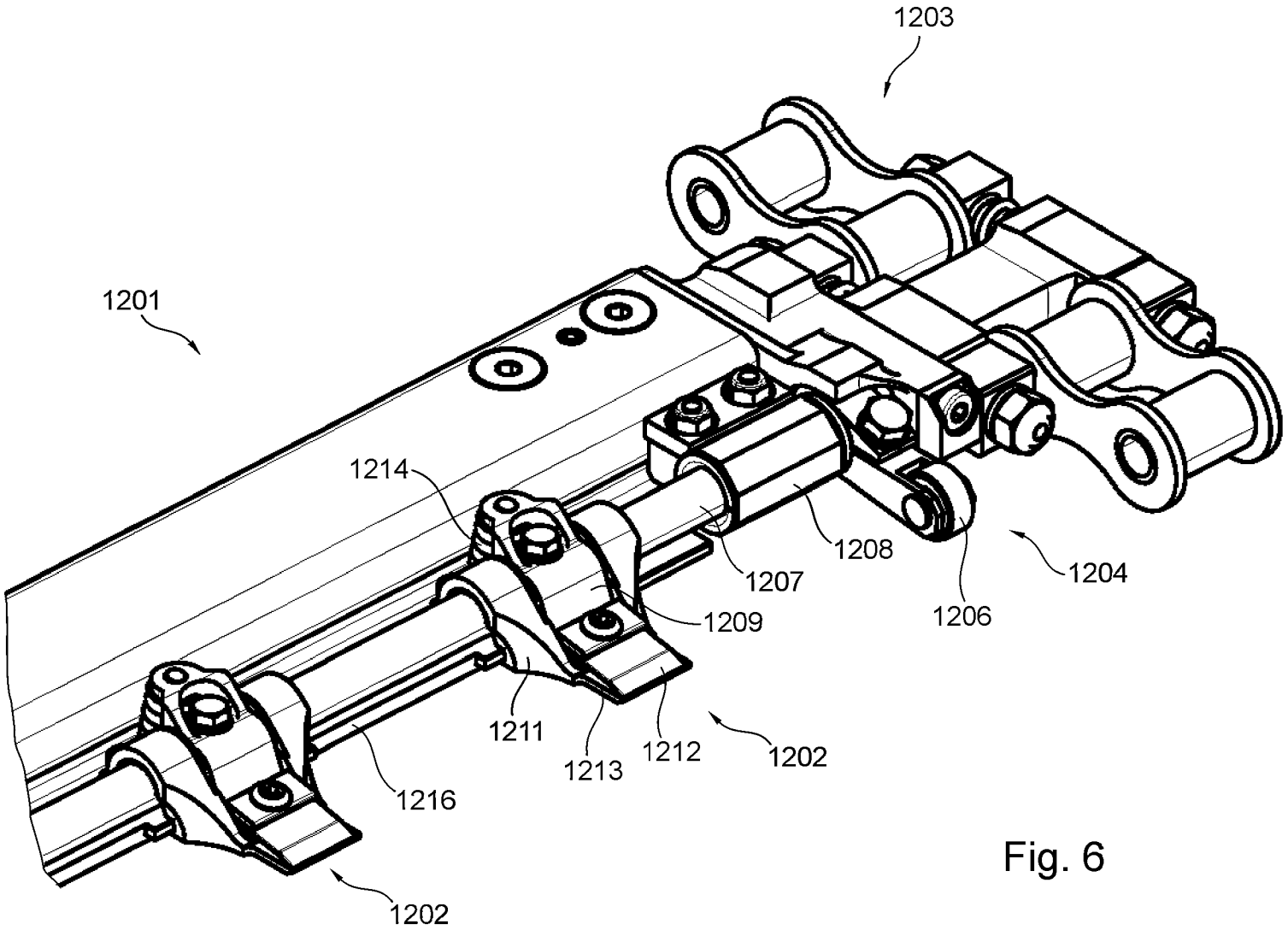
FIG. 6 an enlarged perspective illustration of the chain gripper carriage and of the attachment to a chain in a preferred embodiment.
Figure 7:
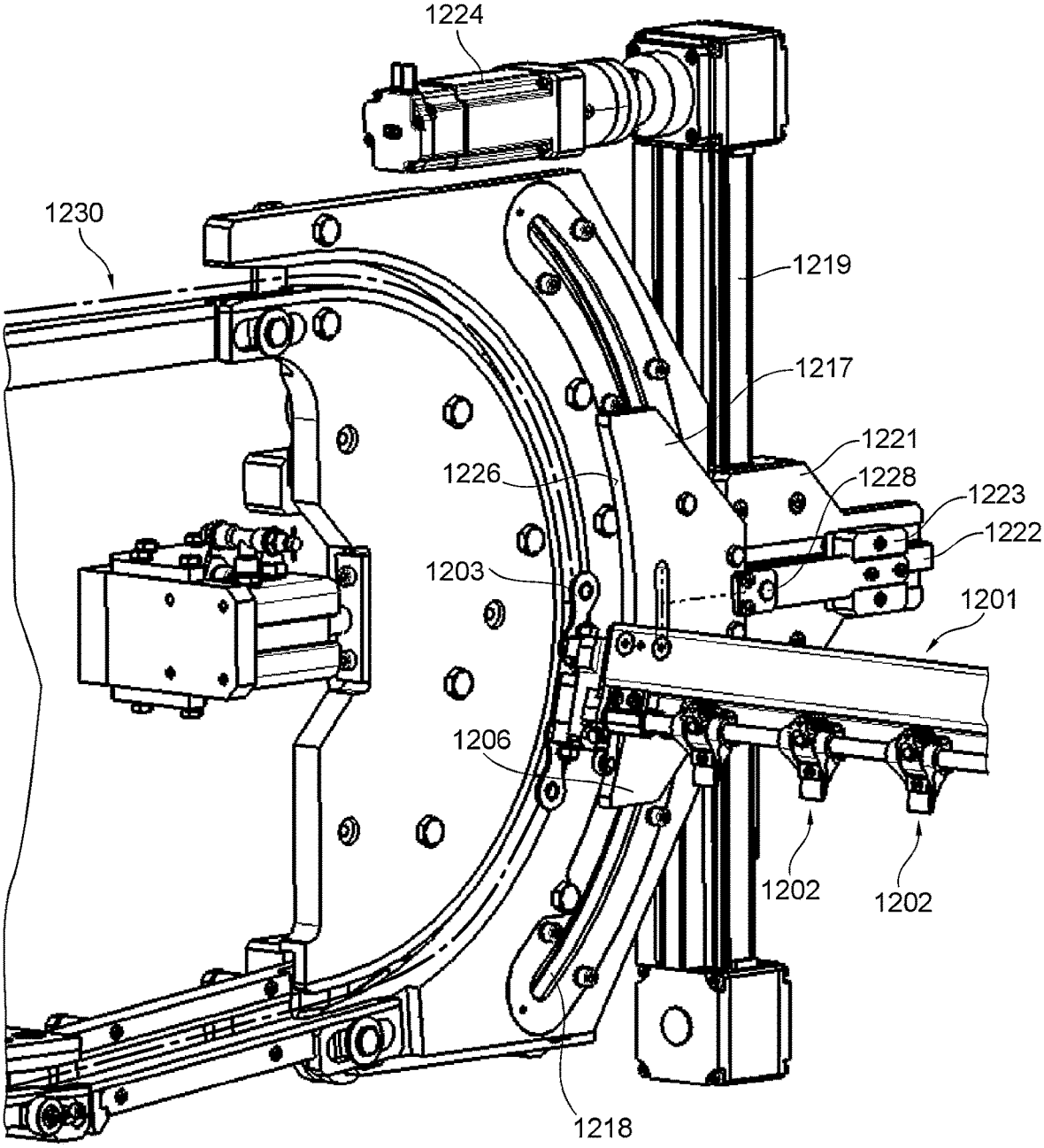
FIG. 7 a perspective illustration of the cooperation of the chain gripper carriage with the chain gripper opener in a preferred embodiment.
Figure 8:
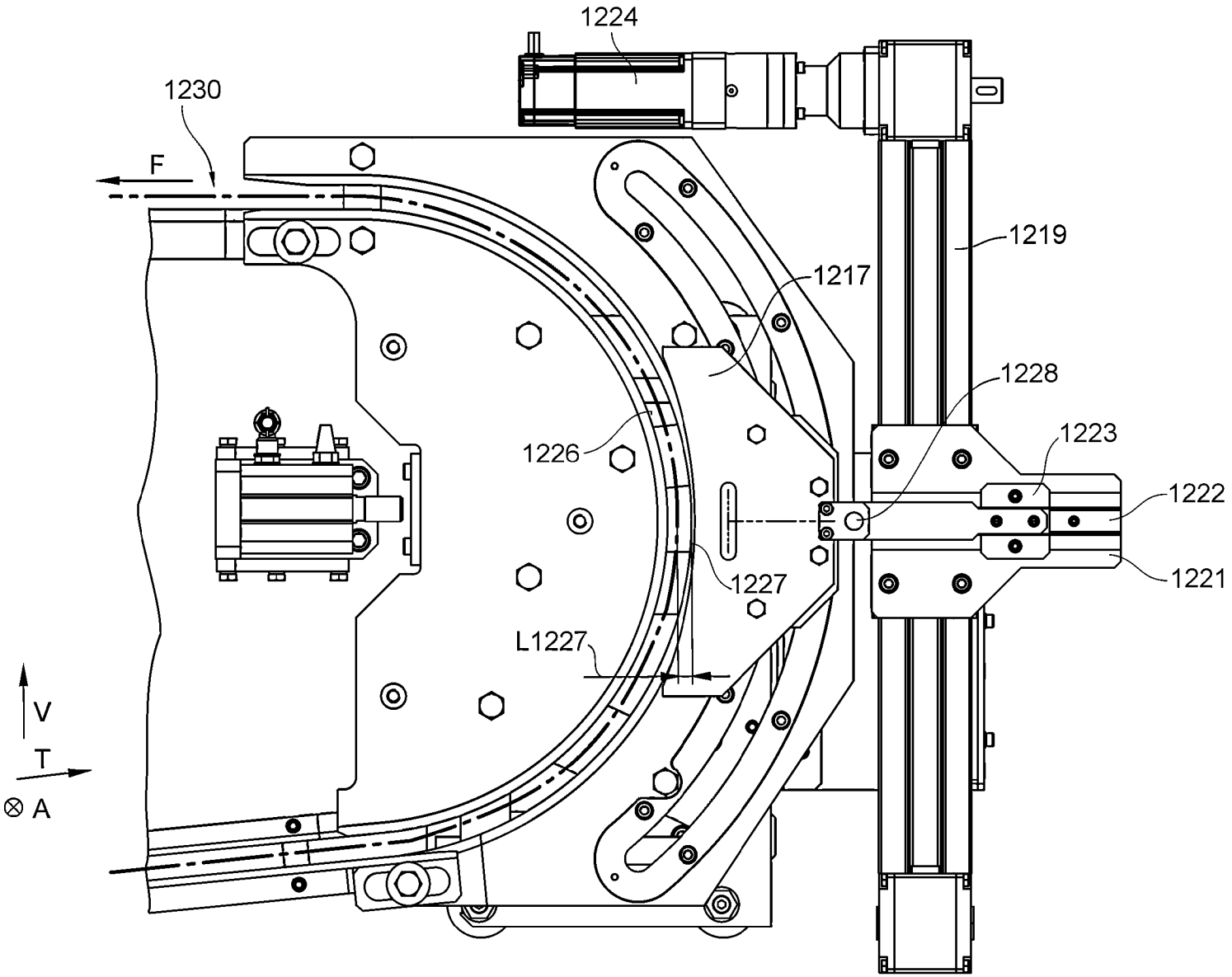
FIG. 8 an illustration of the chain gripper opener in a first position in a preferred embodiment.
Figure 9:
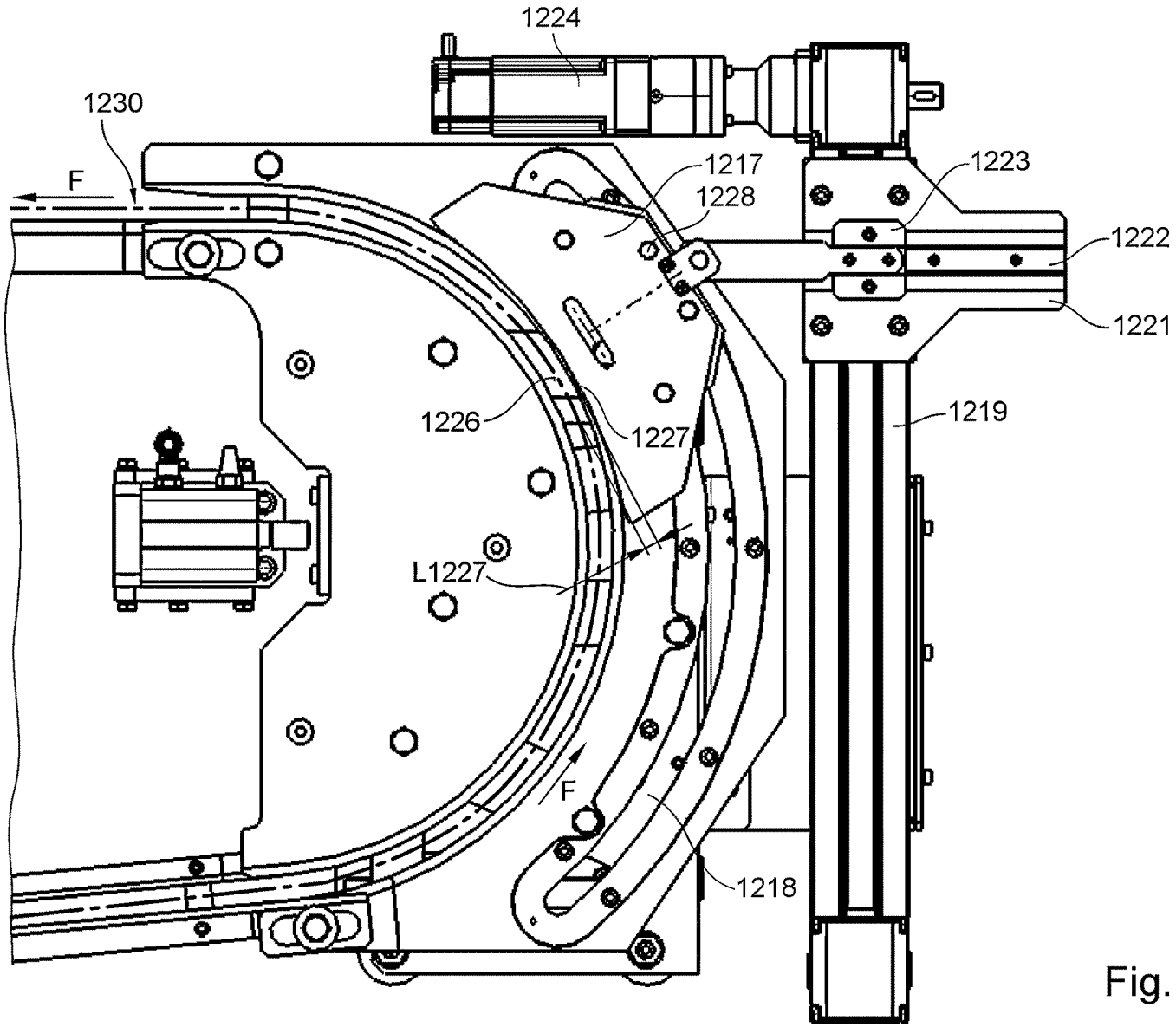
FIG. 9 an illustration of the chain gripper opener in a further position in a preferred embodiment.

A processing machine 01 is preferably configured as a sheet processing machine 01, in particular as a die-cutting machine 01, more preferably as a flat-bed die-cutting machine 01, for processing sheet-like substrate 02 or sheets 02. Above and below, processing machine 01 and/or sheet processing machine 01 also refers to die-cutting machine 01. The processing machine 01 comprises at least one unit 100; 200; 300; 400; 500; 600; 650; 700; 800; 900, preferably a multiplicity of units 100; 200; 300; 400; 500; 600; 650; 700; 800; 900. The processing machine 01, in particular the sheet processing machine 01, preferably comprises at least one unit 300, configured as a shaping unit 300, for processing sheets 02.

Unless an explicit distinction is made, the term sheet-like substrate 02, specifically the term sheet 02, shall generally be understood to encompass any planar substrate 02 that is present in section, i.e., also substrate 02 present in panel- or boards-shaped form, i.e., also panels or boards. The sheet-like substrate 02 or the sheet 02 thus defined is made, for example, of cardboard and/or corrugated cardboard, i.e., cardboard sheets and/or corrugated cardboard sheets, or sheets, panels or possibly boards made of plastic, cardboard, glass, wood, or metal. The sheet-like substrate 02 is more preferably paper and/or paperboard, in particular paper and/or paperboard sheets. Above and below, the term sheet 02 refers, in particular, both to sheets 02 that were not yet processed by means of at least one unit 300; 400; 500; 650, and to sheets 02 that were already processed by means of at least one unit 300; 400; 500; 650 and, in the process, were potentially modified in terms of their shape and/or their mass.

According to DIN 6730 (February 2011), paper is a flat material, consisting mainly of fibers derived from vegetable sources, which is formed by the dewatering of a fiber suspension on a sieve. In the process, a card web is created, which is subsequently dried. The basis weight of paper is preferably a maximum of 225 g/m$^2$ (two hundred and twenty-five grams per square meter).

According to DIN 6730 (February 2011), cardboard is a flat material, consisting mainly of fibers derived from vegetable sources, which is formed by the dewatering of a fiber suspension on a sieve or between two sieves. The fiber structure is compressed and dried. Cardboard is preferably manufactured from cellulose by gluing or pressing the cellulose together. Cardboard is preferably configured as solid board or corrugated cardboard. The basis weight of cardboard is preferably more than 225 g/m$^2$ (two hundred and twenty-five grams per square meter). Corrugated cardboard is cardboard made of one or more layers of corrugated paper that is glued to one layer or between multiple layers of another, preferably smooth, paper or cardboard.

Above and below, the term paperboard preferably refers to a sheet material that is preferably primed on one side and made of paper, having a basis weight of at least 150 g/m$^2$ (one hundred fifty grams per square meter) and no more than 600 g/m$^2$ (six hundred grams per square meter). Paperboard preferably has high strength relative to paper.

A sheet 02 to be worked preferably has a grammage of at least 70 g/m$^2$ (seventy grams per square meter) and/or of no more than 700 g/m$^2$ (seven hundred grams per square meter), preferably no more than 500 g/m$^2$ (five hundred grams per square meter), more preferably no more than 200 g/m$^2$ (two hundred grams per square meter). A sheet 02 to be worked preferably has a thickness of no more than 1 cm (one centimeter), preferably no more than 0.7 cm (zero point seven centimeters), more preferably no more than 0.5 cm (zero point five centimeters), more preferably no more than 0.3 cm (zero point three centimeters).

Above and below, the term multiple-up preferably refers to the number of identical and/or different objects that are produced from the same piece of material and/or are arranged on joint substrate material, for example a joint sheet 02. A multiple-up 03 is preferably the region of a sheet 02 that is either configured as a product of the sheet processing machine 01, in particular as an intermediate product for producing an end product, and/or, for example, is further worked and/or is configured to be further workable to a desired or required end product. The desired or required end product here, which is preferably generated by further working the respective multiple-up 03, is preferably a packaging, in particular a folding box.

Above and below, an offcut piece 04; 05; 06 is the region of a sheet 02 that does not correspond to any multiple-up 03. Collected offcut pieces 04; 05; 06 are preferably referred to as scrap. An offcut piece 04; 05; 06 is preferably configured and/or removable as trim-off and/or broken-off pieces. During the operation of the sheet processing machine 01, the at least one offcut piece 04; 05; 06 is preferably generated in at least one shaping unit 300, preferably by at least one processing step of the respective sheet 02, for example in at least one die-cutting process. During the operation of the sheet processing machine 01, the at least one offcut piece 04; 05; 06 is preferably at least partially removed from the respective sheet 02, and is thus, in particular, separated from the respective multiple-up 03 of the sheet 02. Preferably, at least one unit 400 configured as a stripping unit 400 is configured to remove at least one first offcut piece 04, in particular at least one scrap piece 04, and/or is configured to remove at least one scrap piece 04. Preferably, at least one unit 500 configured as a multiple-up separating unit 500 is configured to remove at least one second offcut piece 06, in particular at least one gripper edge 06, and/or is configured to remove at least one gripper edge 06. For example, a sheet 02 comprises an offcut piece 05 configured as a crosspiece 05. In particular, the multiple-ups 03 are spaced apart from one another by the at least one crosspiece 05.

The spatial area provided for transporting a sheet 02, which the sheet 02, if present, at least temporarily occupies, is the transport path. The transport path is established, at least in a section, by at least one component of a system 1200 configured as a transport system 1200.

A transport direction T is a direction T which is intended for a shaping operating mode of at least one shaping unit 300 of the processing machine 01 and in which the sheet 02, if present, is transported at each point of the transport path. The transport direction T intended, in particular, for transporting sheets 02 is a direction T that is preferably oriented at least substantially horizontally, and more preferably completely horizontally. In addition or as an alternative, the transport direction T preferably points from a first unit 100 of the processing machine 01 to a last unit 800; 900 of the processing machine 01. In particular, the transport direction T points from a unit 100, in particular a feeder unit 100, on the one hand to a unit 600, in particular to a delivery unit 600, on the other hand. In addition or as an alternative, the transport direction T preferably points in a direction in which the sheets 02 are transported, apart from vertical movements or vertical components of movements, in particular from a first contact with a unit 200; 300; 400; 500; 600; 650; 700; 800; 900 of the processing machine 01 arranged downstream from the feeder unit 100 or a first contact with the processing machine 01 to a last contact with the processing machine 01. The transport direction T is preferably the direction T in which a horizontal component points in a direction that is oriented from the feeder unit 100 to the delivery unit 600. The transport direction T preferably points from a feeder side to a delivery side.

The feeder side preferably corresponds to the end face of the sheet processing machine 01, preferably the side on which the at least one feeder unit 100 is arranged. The side of the sheet processing machine 01 located opposite the feeder side preferably corresponds to the delivery side. In particular, the last unit 800; 900 of the sheet processing machine 01, preferably the at least one joint unit 900 and/or the at least one offcut piece delivery unit 800 are arranged on the delivery side. The feeder side and the delivery side are preferably arranged parallel to a direction A, in particular a transverse direction A, and a working width.

The transverse direction A is preferably a horizontally extending direction A. The transverse direction A is oriented orthogonally to the intended transport direction T of the sheets 02 and/or orthogonally to the intended transport path of the sheets 02 through the at least one unit 100; 200; 300; 400; 500; 600; 650; 700; 800; 900 of the processing machine 01. The transverse direction A is preferably oriented from an operator side of the processing machine 01 to a drive side of the processing machine 01.

A vertical direction V is preferably the direction V that is arranged orthogonally to a plane spanned by the transport direction T and the transverse direction A. The vertical direction V is preferably oriented perpendicularly from the bottom and/or from a bottom of the processing machine 01 and/or from a lowermost component of the processing machine 01 toward the top and/or to an uppermost component of the processing machine 01 and/or to an uppermost cover of the processing machine 01.

The operator side of the processing machine 01 is preferably the side of the processing machine 01, parallel to the transport direction T, from which an operator, at least partially and at least temporarily, has access to the individual units 100; 200; 300; 400; 500; 600; 650; 700; 800; 900 of the processing machine 01, for example during maintenance work and/or when replacing at least one shaping tool.

The drive side of the processing machine 01 is preferably the side of the processing machine 01, parallel to the transport direction T, which is located opposite the operator side. The drive side preferably comprises at least portions, preferably at least a majority, of a system 1000, in particular of a drive system 1000.

Above and below, the working width is the maximum width that a sheet 02 can have to be able to be transported through the at least one unit 100; 200; 300; 400; 500; 600; 650; 700; 800; 900, in particular the respective units 100; 200; 300; 400; 500; 600; 650; 700; 800; 900, of the processing machine 01, and/or to still be able to be worked by way of the at least one shaping unit 300 of the processing machine 01; this thus corresponds to the maximum width of the respective sheet 02 that can be worked by way of the at least one shaping unit 300 of the processing machine 01. The working width of the processing machine 01, in particular sheet processing machine 01, is preferably at least 30 cm (thirty centimeters), more preferably at least 50 cm (fifty centimeters), still more preferably at least 80 cm (eighty centimeters), still more preferably at least 120 cm (one hundred twenty centimeters), and still more preferably at least 150 cm (one hundred fifty centimeters).

The sheet 02 to be processed preferably has a sheet width, preferably parallel to the transverse direction A, of at least 200 mm (two hundred millimeters), preferably at least 300 mm (three hundred millimeters), more preferably at least 400 mm (four hundred millimeters). The sheet width is preferably no more than 1,500 mm (one thousand five hundred millimeters), more preferably no more than 1,300 mm (one thousand three hundred millimeters), still more preferably no more than 1,060 mm (one thousand sixty millimeters). A sheet length, preferably parallel to the transport direction A, is, for example, at least 150 mm (one hundred fifty millimeters), preferably at least 250 mm (two hundred fifty millimeters), more preferably at least 350 mm (three hundred fifty millimeters). Furthermore, a sheet length is, for example, no more than 1,200 mm (one thousand two hundred millimeters), preferably no more than 1,000 mm (one thousand millimeters), more preferably no more than 800 mm (eight hundred millimeters).

A sheet 02 has multiple edges 07; 08; 09. In particular, an edge 07 configured as a leading edge 07 is located at the front of the sheet 02 in the transport direction, and is arranged parallel to the transverse direction A. In particular, the leading edge 07 is the edge 07 of the respective sheet 02 which can preferably be seized by at least one component of the sheet processing machine 01, in particular by at least one holding element 1202 of the transport system 1200, for transporting the respective sheet 02, and/or at which at least one component of the sheet processing machine 01 seizes the respective sheet 02, in particular by way of the at least one holding element 1202 of the transport system 1200. An edge 08 configured as a trailing edge 08 is preferably arranged opposite the leading edge 07. More preferably, the leading edge 07 and the trailing edge 08 are arranged parallel to one another. In particular, a trailing edge 08 is located at the rear of the sheet 02 in the transport direction T, and is arranged parallel to the transverse direction A. The sheet 02 furthermore has two edges 09 configured as side edges 09. The two side edges 09 are preferably arranged parallel to the transport direction T and orthogonally to the transverse direction A. Each of the side edges 09 is preferably arranged orthogonally to the leading edge 07 and/or to the trailing edge 08 of the sheet 02.

The sheet 02 preferably includes at least one print image. Above and below, the print image describes a representation on the sheet 02 which corresponds to the sum of all image elements, with the image elements having been transferred and/or being transferable to the sheet 02 during at least one working stage and/or at least one printing operation, preferably prior to being processed by the processing machine 01. The surface of the sheet 02 preferably includes at least one unprinted region, in particular an unprinted edge region. In particular, the at least one holding element 1202 preferably holds the sheet 02 at least at the unprinted edge region of the trailing edge 07, which is configured as an offcut piece 06 and/or a gripper edge 06.

The sheet 02 preferably includes at least one printing mark 11, preferably at least two printing marks 11. Above and below, a printing mark 11 is a mark, for example, for monitoring a color register and/or a perfecting register and/or preferably for aligning the sheet 02 in the transport direction T and/or the transverse direction A.

A unit 100; 200; 300; 400; 500; 600; 650; 700; 800; 900 shall, in each case, preferably be understood to mean a group of devices that functionally cooperate, in particular to be able to carry out a preferably self-contained processing operation of at least one substrate 02. A unit 100; 200; 300; 400; 500; 600; 650; 700; 800; 900 in each case preferably encompasses a machine section of the processing machine 01, which is preferably arranged so as to be at least partially separable from further machine sections.

A system 1000; 1100; 1200 of the processing machine 01 is preferably at least one device that is at least temporarily, in particular permanently, in contact and/or can interact with and/or can be functionally connected to at least one unit 100; 200; 300; 400; 500; 600; 650; 700; 800; 900, preferably at least two different units 100; 200; 300; 400; 500; 600; 650; 700; 800; 900 of the processing machine 01.

The processing machine 01 preferably comprises at least one unit 100 configured as a feeder unit 100. The feeder unit 100 is preferably configured as a feeder 100, more preferably as a sheet feeder 100, more preferably as a sheet feeder unit 100. The feeder unit 100 is preferably configured as the first unit 100 of the processing machine 01 in the transport direction T. The feeder unit 100 is preferably configured to feed sheets 02 to the processing machine 01 on the transport path and/or configured to feed sheets 02 to at least one unit 200; 300; 400; 500; 600; 650; 700; 800; 900 arranged downstream from the feeder unit 100 in the transport direction T.

At least one unit 200 configured as an infeed unit 200 is preferably arranged downstream from the at least one feeder unit 100 in the transport direction T. The at least one infeed unit 200 is preferably configured to feed sheets 02, preferably from a sequential supply of sheets 02, to the at least one shaping unit 300. The at least one infeed unit 200 preferably comprises at least one device for detecting sheets 02. A respective sheet 02 can preferably be at least partially, preferably completely, aligned by the at least one infeed unit 200 with respect to its position in the transport direction T and/or in the transverse direction A.

At least one unit 300 configured as a shaping unit 300 is preferably arranged downstream from the at least one feeder unit 100 in the transport direction T, and preferably downstream from the at least one infeed unit 200. The at least one shaping unit 300 preferably comprises at least one shaping mechanism 301. The shaping mechanism 301 is preferably configured as a die-cutting mechanism 301, more preferably as a flat-bed die-cutting mechanism 301. The corresponding unit 300 is then preferably configured as a die-cutting unit 300 and/or a creasing unit 300 and/or a cutting unit 300 and/or a die cutter 300, more preferably as a flat-bed die-cutting unit 300 and/or a flat-bed die-cutter 300.

Above and below, a device for partially severing and/or reducing the thickness of and/or stripping away the sheet 02 to be processed, in particular of the packaging material, is referred to as a creasing unit 300. In particular, notches and/or creases are introduced into the preferably paper-containing or paperboard-containing packaging material, in particular the sheet 02. In the case of corrugated cardboard, for example, the uppermost layer is severed in at least one creasing unit 300. In particular, the sheet 02, in particular the packaging material, can thus preferably be bent and/or folded into a certain shape, for example a three-dimensional shape, with lower force expenditure. A device for severing, preferably for completely severing, the sheet 02, in particular the packaging material, at certain points is referred to as a cutting unit 300 or a die-cutting unit 300. In particular, the at least one offcut piece 04; 05; 06, in particular the packaging material that is not required, can thus subsequently be easily separated from the multiple-ups 03.

The at least one shaping mechanism 301 preferably comprises at least one upper shaping tool, in particular at least one upper die-cutting tool, and/or at least one lower shaping tool, in particular at least one lower die-cutting tool. The at least one upper shaping tool is preferably in each case assigned at least one lower shaping tool, preferably exactly one lower shaping tool. At least one shaping tool is preferably configured to be movable, preferably movable in the vertical direction V. More preferably, at least one upper shaping tool and/or at least one lower shaping tool is in each case configured to be movable in the vertical direction V. The at least one upper shaping tool and the at least one lower shaping tool are preferably synchronized with respect to one another, and in particular with respect to the multiple-up 03 and/or the sheet 02. Preferably, in particular when both the at least one upper shaping tool and the at least one lower shaping tool are configured to be movable, the movement of respective shaping tools is preferably synchronized and/or can be synchronized in terms of time. The respective upper shaping tool and the respective lower shaping tool preferably have opposing relative movements with respect to one another during a die-cutting operation, so that the shaping tools are moved and/or can be moved relative toward one another and/or away from one another in the vertical direction V. The at least one upper shaping tool is preferably at least temporarily, preferably at least once per machine cycle, more preferably in a closed position of the at least one shaping mechanism 301, in direct contact with the at least one lower shaping tool. The at least one upper shaping tool is preferably spaced apart from the at least one lower shaping tool at a distance of greater than zero in an open position of the shaping mechanism 301.

The processing machine 01 preferably comprises at least one drive system 1000. The respective shaping tool is preferably in contact with, preferably functionally connected to, the at least one drive system 1000 and/or can be at least temporarily driven, preferably by way of a cyclical movement, by the drive system 1000.

A sheet 02 that has been processed by the at least one shaping unit 300, i.e., that is arranged downstream from the at least one shaping unit 300 on the transport path in the transport direction T, preferably includes at least one die-cut impression. The at least one die-cut impression is configured as a crease and/or a score mark and/or an embossment and/or a cut and/or a perforation, for example. The at least one die-cut impression, in particular when it is configured as a perforation and/or a cut, is preferably configured to at least partially separate the at least one multiple-up 03 from at least one offcut piece 04; 05; 06 and/or from at least one further multiple-up 03 of the relevant sheet 02. A sheet 02 that has been processed by the at least one shaping unit 300, i.e., that is arranged downstream from the at least one shaping unit 300 on the transport path in the transport direction T, preferably comprises the at least one multiple-up 03, preferably at least two multiple-ups 03, and at least one offcut piece 04; 05; 06.

At least one unit 400 configured as a stripping unit 400 is arranged downstream from the at least one shaping unit 300 in the transport direction T, preferably subsequent to the at least one shaping unit 300, more preferably without a further unit of the processing machine 01 being interposed. The at least one stripping unit 400 is preferably configured to remove the at least one first offcut piece 04, preferably to remove the at least one scrap piece 04, from the respective sheet 02. The at least one stripping unit 400 preferably comprises at least one stripping mechanism 401.

A sheet 02 that has been processed by the at least one stripping unit 400, i.e., that is arranged downstream from the at least one stripping unit 400 on the transport path in the transport direction T, preferably only comprises the at least one multiple-up 03, in particular a multiplicity of multiple-ups 03, and the at least one second offcut piece 06. For example, the sheet 02 that has been processed by the at least one stripping unit 400 additionally comprises the at least one crosspiece 05.

At least one unit 500 configured as a multiple-up separating unit 500 is preferably arranged downstream from the at least one shaping unit 300, in particular the at least one die-cutting unit 300. When the at least one stripping unit 400 is present, the at least one multiple-up separating unit 500 is also arranged downstream from the at least one stripping unit 400 in the transport direction T. The at least one multiple-up separating unit 500 comprises at least one multiple-up separating mechanism 501 for separating the multiple-ups 03 and the at least one remaining offcut piece 05; 06 from one another.

The sheet processing machine 01 furthermore preferably comprises at least one unit 600, in particular a delivery unit 600 for delivering and stacking the multiple-ups 03, more preferably a delivery 600. In the transport path of the sheets 02, the at least one delivery unit 600 is arranged downstream from the at least one die-cutting unit 300, and more preferably the at least one multiple-up separating unit 500 and/or the at least one stripping unit 400. In a preferred embodiment, the at least one multiple-up separating unit 500 comprises the at least one delivery unit 600, with the two units 500; 600 preferably being configured as a joint unit 650.

Furthermore, the sheet processing machine 01 preferably comprises the at least one unit 700, which is preferably configured as a sheet insert unit 700. The at least one sheet insert unit 700 is preferably assigned to the at least one multiple-up separating unit 500, and more preferably is arranged downstream from the at least one multiple-up separating unit 500 in the transport direction T. The at least one sheet insert unit 700 preferably inserts at least one sheet 02, preferably at least one unprocessed sheet 02, into a pile of sheets 02 and/or multiple-ups 03, which are preferably separated from one another, to increase the stability. The sheet processing machine 01, in particular, comprises the sheet insert unit 700 for inserting a sheet 02 into a pile of multiple-ups 03. The sheet insert unit 700 preferably comprises at least one pile formation device 701. Furthermore, the at least one pile formation unit 700 [sic] comprises at least one sheet cartridge 702, in particular an intermediate sheet cartridge 702, for holding, preferably unprocessed, sheets 02. The sheet insert unit 700 can also be arranged downstream from the joint unit 650.

Furthermore, the sheet processing machine 01 preferably comprises at least one unit 800 for collecting offcut piece 05; 06 configured as an offcut piece delivery unit 800. In particular, the at least one offcut piece 05; 06 is separated from the at least one multiple-up 03, preferably all multiple-ups 03. The at least one offcut piece delivery unit 800 is preferably arranged downstream from the multiple-up separating unit 700 [sic] in the transport direction T. More preferably, the at least one offcut piece delivery unit 800 is arranged downstream from the at least one delivery unit 600. In a preferred embodiment, the at least one offcut piece delivery unit 800 is encompassed by the at least one sheet insert unit 700, and these are configured as a joint unit 900.

The at least one drive system 1000 is preferably functionally connected to at least one system 1100, in particular a control system 1100, and/or the at least one transport system 1200.

The at least one drive system 1000 preferably comprises at least one clock generator and/or angular position transducer, more preferably exactly one clock generator and/or angular position transducer. The at least one clock generator and/or angular position transducer is preferably configured to generate a guide value, for example a virtual guide value and/or a guide value in the form of pulses, by way of which movements of components of the processing machine 01 can be synchronized and/or are synchronized.

Furthermore, the at least one sheet processing machine 01 comprises at least one system 1200 configured as a transport system 1200. The at least one transport system 1200 guides the sheets 02, preferably continuously holding them, through the sheet processing machine 01 and, in particular, at least through the units 300; 400; 500; 650. In particular, the sheets 02 are preferably guided at least substantially horizontally in the transport direction T through the sheet processing machine 01. The transport system 1200 is preferably configured as a chain transport system 1200, and more preferably as a chain gripper system 1200. In particular, the at least one chain transport system 1200 comprises at least one guide device 1203, wherein the at least one guide device 1203 is preferably configured as at least one chain 1203. In particular, the at least one guide device 1203 is at least partially, preferably completely, arranged outside the transport path. The chain gripper system 1200 is preferably configured with at least one carriage, preferably with multiple carriages, 1201, in particular a gripper carriage 1201. In particular, the at least one guide device 1203 holds the at least one gripper carriage 1201, preferably all gripper carriages 1201, and establishes the position of the at least one gripper carriage 1201 in at least one transport system 1200. In particular, the respective gripper carriage 1201, during sheet guidance, has a position in the transport direction T that is predefined by the at least one guide device 1203. The at least one holding element 1202, in particular the at least one gripper 1202, is preferably arranged at each carriage 1201. In particular, each gripper carriage 1201 comprises multiple holding elements 1202, preferably grippers 1202, in the transverse direction A across the working width, preferably at equal distances with respect to one another. The at least one holding element 1202 is preferably transferred from an open position into a closed position for gripping a sheet 02. A sheet 02 is preferably seized by the at least one holding element 1202 at the transfer position of the at least one infeed unit 200. For depositing the at least one second offcut piece 06, preferably in the at least one offcut piece delivery unit 800, the at least one holding element 1202 is preferably transferred from a closed position into an open position. The chain gripper system 1200 preferably has a cyclical and/or periodic movement for transporting sheets through the units 300; 400; 500; 650. In particular, the movement is configured to be so periodic and/or cyclical that the sheet 02 and/or the gripper carriage 1201, in particular the chain gripper carriage 1201, are at a standstill during the processing step in one of the units 300; 400; 500; 650. In particular, the at least one chain gripper carriage 1201 and/or the sheet 02 are in motion between the individual processing steps. The transport system 1200 is coupled to and synchronized with the transport means of the individual units via the control system 1100 and the drive system 1000.

The at least one drive system 1000 preferably comprises at least one drive. For example, the at least one drive is configured as a central drive of the processing machine 01. The drive system 1000 preferably comprises a drive configured as a central drive. The at least one drive is preferably configured to transmit torque and/or linear movement to at least one component of at least one unit 100; 200; 300; 400; 500; 600; 650; 700; 800; 900, for example at least one transport means, and/or to at least one component of the transport system 1200. The at least one drive is preferably configured to transmit torque and/or linear movement to at least two different components of the same unit 100; 200; 300; 400; 500; 600; 650; 700; 800; 900 and/or two different units 100; 200; 300; 400; 500; 600; 650; 700; 800; 900 and/or to at least one component of the transport system 1200. The at least one drive is preferably in contact with and/or functionally connected to at least one component of at least one unit 100; 200; 300; 400; 500; 600; 650; 700; 800; 900 which is to be moved at least temporarily and/or at least one component of the transport system 1200. The at least one drive of the at least one drive system 1000 is preferably linked, and/or can be linked, to at least one component of at least one unit 100; 200; 300; 400; 500; 600; 650; 700; 800; 900 to be moved, preferably to all components of the respective unit 100; 200; 300; 400; 500; 600; 650; 700; 800; 900, or of the respective units 100; 200; 300; 400; 500; 600; 650; 700; 800; 900, which are to be moved by the respective drive, and/or to at least one component of the transport system 1200 to be moved, in such a way that the respective component to be moved, and preferably all components to be moved by the drive, can be operated and/or are operated in a synchronized manner.

The at least one drive system 1000 is preferably configured to transmit cyclical and/or periodic movements to at least one component of at least one unit 100; 200; 300; 400; 500; 600; 650; 700; 800; 900 and/or of the transport system 1200 by way of the at least one drive.

In a preferred embodiment, the at least one drive system 1000 comprises exactly one drive, which is preferably linked to different components of different units 100; 200; 300; 400; 500; 600; 650; 700; 800; 900 and/or to at least one component of the transport system 1200.

The at least one drive of the drive system 1000 is preferably configured as an electric motor, more preferably as a servo motor.

The sheet processing machine 01 preferably comprises at least one system 1100, in particular at least one control system 1100, for open-loop control and/or for closed-loop control. The at least one control system 1100 is functionally connected to the units 100; 200; 300, 400; 500; 600; 650; 700; 800; 900 and the at least one drive, for example. The multiple units 100; 200; 300, 400; 500; 600; 650; 700; 800; 900 are preferably functionally connected to one another via the at least one control system 1100 and are synchronized and/or can be synchronized. The sheet processing machine 01 comprises multiple sensors, wherein the input signals thereof are detected and processed in at least one control system 1100. For example, at least one output signal is generated via the at least one control system 1100, which controls, by open-loop control and/or closed-loop control, at least one component of a unit 100; 200; 300, 400; 500; 600; 650; 700; 800; 900 and/or is connected to a component of a unit 100; 200; 300, 400; 500; 600; 650; 700; 800; 900 so as to control the same by open-loop and/or closed-loop control. For example, the at least one drive of the at least one drive system 1000 and/or an alignment of sheets 02 and/or an infeed of sheets 02 into the processing machine 01 and/or an insertion of sheets into the at least one delivery pile can be controlled, by open-loop control and/or closed-loop control, via the at least one control system 1100. An operator can, for example, at least partially intervene in the mode of operation of the sheet processing machine 01 via a control console that is functionally connected to the at least one control system 1100.

The at least one stripping unit 400 preferably comprises at least one stripping mechanism 401. The at least one stripping mechanism 401 preferably comprises at least one upper stripping tool and/or at least one lower stripping tool, wherein the respective stripping tool is preferably configured in each case to be movable in the vertical direction V. The upper stripping tool is preferably configured to be movable with a vertical relative movement with respect to the lower stripping tool. The at least one upper stripping tool and the at least one lower stripping tool are preferably configured to be movable relative toward one another and/or away from one another in the vertical direction V. The at least one upper stripping tool and the at least one lower stripping tool are preferably synchronized with respect to one another, and in particular with respect to the multiple-up 03 and/or sheet 02. The at least one upper stripping tool is preferably at least temporarily, preferably at least once per machine cycle, more preferably in a closed position of the at least one stripping mechanism 401, in direct contact with the at least one lower stripping tool. The at least one upper stripping tool is preferably spaced apart from the at least one lower stripping tool at a distance of greater than zero in an open position of the stripping mechanism 401.

The respective stripping tool is preferably in contact with, preferably functionally connected to, the at least one drive system 1000 and/or can be at least temporarily driven, preferably by way of a cyclical movement, by the at least one drive of the drive system 1000. Preferably, the movement of the respective stripping tools is preferably synchronized and/or can be synchronized in terms of time.

Preferably, the at least one first offcut piece 04 can be separated at least partially, preferably completely, from the at least one multiple-up 03 of the sheet 02 and/or can be removed at least partially, preferably completely, from the at least one sheet 02, by closing the respective stripping tools, i.e., by positioning the relevant stripping mechanism 401 in the closed position.

In particular, the at least one multiple-up separating mechanism 501 comprises at least one upper multiple-up separating tool arranged above in the vertical direction V and at least one lower multiple-up separating tool arranged therebeneath. The at least one upper multiple-up separating tool and the at least one lower multiple-up separating tool are preferably synchronized with respect to one another, and in particular with respect to the multiple-up 03. The lower multiple-up separating tool comprises a spatial area for stacking and/or temporarily storing the multiple-ups 03. The at least one upper multiple-up separating tool preferably comprises at least one pushing device, in particular a pushing device configured as an elevation of the at least one upper multiple-up separating tool. The at least one pushing device is configured so as to be protrudable and, in a closed position of the at least one multiple-up separating mechanism 501, to protrude into the spatial area, in particular into a recess, of the at least one lower multiple-up separating tool. The transport path of the sheet 02, established by the transport system 1200, in particular by the transport system 1200 configured as a chain gripper system 1200, through the at least one multiple-up separating unit 500 is preferably arranged between the at least one upper multiple-up separating tool and the at least one lower multiple-up separating tool in an open position of the relevant multiple-up separating mechanism 501. In a closed position of the relevant multiple-up separating mechanism 501, at least the upper multiple-up separating tool is arranged so as to penetrate into the transport path of the sheet 02. The multiple-ups 03 are separated from the remaining offcut pieces 05; 06 by changing the position of the at least one multiple-up separating mechanism 500, preferably only of the upper multiple-up separating tool, from the open position into the closed position. In particular, a multiple-up 03 is thus arranged so as to be detached from contact with the at least one transport system 1200. This process is, in particular, repeated cyclically and/or periodically by coupling to the at least one drive system 1000. In particular, the position of the at least one multiple-up separating mechanism 501 is changed exactly whenever a sheet 02 is situated in the transport path beneath the at least one upper multiple-up separating tool.

In this preferred embodiment, the at least one delivery 600 is, in particular, arranged in the vertical direction beneath the lower multiple-up separating tool. The multiple-ups 03 are preferably stacked on at least one pile, preferably at least one delivery pile, after having been temporarily stored in the lower multiple-up separating tool. The at least one delivery pile preferably comprises at least two, preferably a multiplicity, of individual piles of multiple-ups 03 next to one another. The at least one delivery pile is preferably arranged so as to be movable and/or displaceable in the vertical direction V by means of a lifting device. In particular, it is thus possible to adapt the height of the at least one delivery pile, for example, to the lower multiple-up separating tool and/or to at least one pile formation device 701.

The at least one pile formation device 701, for the purpose of pile formation, is preferably arranged to be movable and/or inwardly movable and/or to move and/or be inwardly move between the lower multiple-up separating tool and the at least one delivery pile. This is in particular the case when the at least one intermediate reservoir of the at least one lower multiple-up separating tool in the at least one multiple-up separating unit 500 is at least partially, preferably completely, filled with multiple-ups 03 and/or has a sufficiently great instability, so that at least one individual pile is at risk of tilting. In particular, the at least one lifting device is preferably matched to the at least one pile formation device 701, and is in particular arranged in the vertical direction V beneath the at least one pile formation device 701, preferably without any further device being interposed.

In particular, the offcut pieces 05; 06 in the at least one offcut piece delivery unit 800 are detached by at least one holding element 1202, in particular at least one gripper 1202, of the at least one transport system 1200 and collected as scrap by means of at least one collection device. For example, this at least one collection device is configured as at least one conveyor belt comprising at least one collection container.

Furthermore, the at least one chain gripper carriage 1201, with the at least one holding element 1202, is arranged so as to be attached to the at least one chain 1203. In particular, the at least one chain 1203 preferably comprises multiple chain links. Preferably, the at least one chain gripper carriage 1201 is arranged so as to be attached between two chain links. In particular, the at least one chain gripper carriage 1201 is arranged so as to be movable relative to the chain 1203, preferably in and/or counter to the transport direction T. More preferably, the at least one chain gripper carriage 1201 is arranged so as to be movable relative to the chain 1203, at least in the transport direction T. For example, the at least one chain gripper carriage 1201 is arranged so as to be movable between 2 mm and 10 mm, preferably by 4 mm, relative to the chain 1203. In particular, the at least one chain gripper carriage 1201 comprises at least one, preferably two springs that hold the at least one chain gripper carriage 1201 in position relative to the at least one chain 1203. The at least one chain 1203 is arranged so as to guide the at least one chain gripper carriage 1201 on a guide path 1230 through at least part of the sheet processing machine 01.

The at least one chain gripper carriage 1201 comprises the at least one contact element 1206. The at least one contact element 1206 is in particular functionally connected to the at least one holding element 1202. The at least one holding element 1202 can be transferred from a closed position into an open position, for example, by a displacement of the at least one contact element 1206.

The at least one chain gripper carriage 1201 furthermore comprises at least one shaft 1207. The at least one shaft 1207 is preferably functionally connected to the at least one, preferably the multiple holding elements 1202 and to the at least one contact element 1206. In particular, the at least one shaft 1207 is rotatably mounted on the at least one chain gripper carriage 1201 by way of at least one mounting 1208. Upon rotation of the at least one shaft 1207, for example by actuating or displacing of the at least one contact element 1206, the at least one holding element 1202 can be transferred and/or is transferred, for example, from a closed position into an open position.

The at least one chain 1203 is arranged so as to guide the at least one chain gripper carriage 1201 at least partially on a guide path 1230 through the sheet processing machine 01. The guide path 1230 is in particular established by multiple components of the sheet processing machine 01. For example, the at least one sheet processing machine 01 comprises various guide elements. In particular, at least some of the guide elements 1205 are configured as guide rails 1205. The at least one chain 1203 is arranged so as to run on the guide elements 1205, for example. In another embodiment, or in another part of the processing machine 01, the guide elements 1205 are in each case arranged so as to predefine and surround the guide path 1230 on both sides.

To support the guidance of the chain 1203, the chain links are each configured with elevations at the end faces. In particular, the elevations and/or edge portions of the chain links are arranged so as to protrude beyond the guide rail 1205 in the transverse direction A, and so as to additionally fix the chain 1203 in the guide rail 1205. In particular, a movement in and/or counter to the transverse direction A is thus prevented.

Furthermore, the at least one chain 1203 is arranged to pass through the guide path 1230 during the machine operation, preferably in a guide direction F. In particular, the guide direction F is the direction F that, at a point on the guide path 1230, is tangential to the guide path 1230. In particular, the guide direction F partially agrees with the transport direction T, preferably at least within the transport path.

The guide path 1230 is preferably configured in a streamlined manner and is formed by the connecting line of the centroids of a projection of the individual chain links. In particular, the projection is formed as the projection of the individual chain links into the plane spanned by the transport direction T and the vertical direction V. In the embodiment or the part of the sheet processing machine 01 comprising surrounding guide rails 1205, the guide path 1230 is arranged between the guide rails 1205. The guide rails 1205 preferably include running surfaces on which the chain 1203 is arranged to run. The guide path 1230 is in particular arranged between the running surfaces. In the case of linearly configured running surfaces, the guide path 1230 preferably is configured as the center line of the two running surfaces and/or the midline of the running surfaces. In the case of curved guide rails 1205, the guide path 1230 is configured as a connecting line of all points on the center lines of points on the running surfaces located opposite the tangents and by the straight connecting line of the opposing points. In the case of a circular guide path 1230, the guide path 1230 is configured as a mean diameter between the two guide rails 1205.

More preferably, the guide path 1230 is configured to be at least partially curved. In particular, at least the at least one offcut piece delivery unit 800 comprises at least one curved section including a curved guide path 1230. For example, the curved guide path 1230 has a radius of curvature of less than 3 meters (three meters), more preferably less than 1 meter (one meter).

The at least one chain gripper carriage 1201 comprises multiple holding elements 1202. For example, each holding element 1202 comprises an upper holding element 1209 and a lower holding element 1211. The at least one lower holding element 1211 is preferably arranged in a stationary and immovable manner with the at least one chain gripper carriage 1201, and more preferably fixed on a fixing device 1216. The at least one fixing device 1216 is preferably configured as a rod and/or bar that is fixedly connected to the chain gripper carriage 1201 and preferably extends across the entire width of each chain gripper carriage 1201 in the transverse direction A. Preferably, a sheet 02 and/or an offcut piece 06 are arranged between the at least one upper holding element 1209 and the at least one lower holding element 1211.

In particular, the lower holding element 1211 comprises at least one lower contact 1213, and the upper holding element 1209 comprises at least one upper contact 1212. The at least one lower holding element 1211 is preferably in contact with the sheet 02 and/or the offcut piece 06 via the at least one lower contact 1213, and the at least one upper holding element 1209 is preferably in contact with the sheet 02 and/or the offcut piece 06 via the at least one upper contact 1212. In particular, the at least one upper holding element 1209 and the at least one lower holding element 1211, in a closed position of the at least one holding element 1202, are arranged in such a way that a sheet 02 and/or an offcut piece 06 is being held. In particular, the upper contact 1212 and the lower contact 1213 apply pressure onto the sheet 02 and/or the offcut piece 06. If no sheet 02 and/or offcut piece 06 is transported by the chain gripper carriage 1201, the lower contact 1213 and the upper contact 1212 are held in contact with one another in the closed position of the at least one holding element 1202. Preferably, at least one spring 1214 is arranged to as to apply the pressure. The at least one spring 1214 is preferably arranged between the fixing device 1216 and the upper holding element 1209. The at least one spring 1214 is preferably arranged so as to be press the at least one upper holding element 1209 against the at least one lower holding element 1211.

In an open position of the at least one holding element 1202, the at least one lower contact 1213 is arranged so as to be spaced apart from the at least one upper contact 1212. In particular, the at least one upper holding element 1209 is arranged so as to be pivoted away from the at least one lower holding element 1211 against the pressure of the spring 1214. The at least one upper holding element 1209 is preferably arranged so as to be pivoted away by rotation of the shaft 1207.

In particular, the shaft 1207 is connected to an opening element 1204. The at least one opening element 1204 preferably comprises at least one contact element 1206. The at least one contact element 1206 can be contacted via a chain gripper opener 1217, for example. Through contact of the at least one contact element 1206 with the at least one chain gripper opener 1217, the at least one opening element 1204 is arranged so as to cause the at least one shaft 1207 to rotate. In particular, the at least one holding element 1211 can be transferred from a closed position into an open position by way of a functional connection of the at least one contact element 1206 with the at least one chain gripper opener 1217. As a function of the displacement of the contact element 1206, the at least one holding element 1209 is arranged so as to be opened to varying degrees.

The at least one sheet processing machine 01 and/or the die-cutting machine 01 furthermore comprise at least one chain gripper opener 1217. The at least one chain gripper opener 1217 is arranged at a position along the guide path 1230. In a preferred embodiment, the at least one chain gripper opener 1217 is arranged in the at least one unit 800, more preferably in the at least one offcut piece delivery unit 800.

The at least one chain gripper opener 1217 includes at least one contact surface 1226 at which, in the presence of the at least one chain gripper carriage 1201 at the contact surface 1226, the at least one contact element 1206 is arranged so as to cooperate with the at least one chain gripper opener 1217. In particular, the at least one holding element 1202 is arranged to be transferred at least from a closed position into an open position by way of the cooperation of the at least one chain gripper opener 1217 with the at least one contact element 1206. The at least one contact element 1206 is preferably arranged to be transferred back from the open position into the closed position after having been transferred from the closed position into the open position.

The at least one contact surface 1226 of the at least one chain gripper opener 1217 has a curvature that is adapted to the guide path 1230. In particular, the at least one chain gripper opener 1217 preferably has a lesser curvature than the guide path 1230. In particular, the contact surface 1226 includes a region at which the distance with respect to the guide path 1230 is minimal, and at which, during the cooperation of the at least one contact surface 1226 with the at least one chain gripper carriage 1201, the at least one holding element 1202 is preferably arranged in a maximally opened manner. Along the guide path 1230, further regions of the at least one contact surface 1226 in which a distance between the at least one contact surface 1226 and the guide path 1230 steadily increases follow from the region having the smallest distance between the at least one contact surface 1226 and the guide path 1230. In particular, the at least one contact surface 1226 is preferably symmetrically configured and, in and/or counter to the guide direction F, the distance between the at least one contact surface 1226 and the guide path 1230 is arranged so as to be increased.

The at least one contact surface 1226 furthermore includes an opening region 1227 that is arranged along the guide path 1230. At the opening region 1227, the at least one holding element 1202 is arranged so as to start the transfer from a closed position into an open position.

During the projection of the contact surface 1226 into the plane that is spanned by the vertical direction V and the transport direction T, the contact surface 1226 is preferably configured as a line, and the opening region 1227 is preferably configured as a point on the line. In particular, the opening region 1227 has a distance L1227 with respect to the guide path 1230. The distance L1227, on any point of the opening region 1227, with respect to the guide path 1230 is preferably identical and preferably corresponds to the distance between the projection of the opening region 1227 into the plane that is spanned by the vertical direction V and the transport direction T and the guide path 1230.

The at least one chain gripper opener 1217 is preferably arranged so as to be adjustable. In particular, the at least one chain gripper opener 1217 is arranged to be adjustable in such a way that the at least one opening region 1227 is adjustable so as to be equidistant with respect to the guide path 1230. In particular, the distance L1227 between the at least one opening region 1227 and the guide path 1230 is equidistant during the adjustment of the at least one chain gripper opener 1217. In particular, the distance between the projection of the opening region 1227 into the plane that is spanned by the transverse direction A and the transport direction T and the guide path 1230 is arranged to be equidistant when the at least one chain gripper opener 1217 is adjusted.

Above and below, equidistant adjustment denotes an adjustment of the at least one chain gripper opener 1217 during which the distance L1227 between the opening region 1227 and the guide path 1230 is arranged so as to vary by less than 10%. In a preferred embodiment, the at least one chain gripper opener 1217 is arranged so as to be adjustable along a curved section of the guide path 1230.

The at least one chain gripper opener 1217 is in particular arranged so as to be adjustable on a guide 1218. In a preferred embodiment, the at least one guide 1218 is arranged so as to be equidistant with respect to the guide path 1230 of the at least one chain gripper carriage 1201. In particular, the shortest distance between a point on the guide 1218 and a point on the guide path 1230 along the guidance is preferably arranged to be equidistant and/or identical or in a manner that deviates by less than 10%.

Furthermore, the at least one chain gripper opener 1217 comprises at least one guide element, which is preferably arranged to run in the guide 1218. In particular, a movement of the at least one guide element is predefined by the guide 1218, for example with little clearance. The at least one chain gripper opener 1217 is preferably arranged so as to be only adjustable along the guide 1218. The at least one guide element is advantageously configured as a roller and/or cylinder.

The at least one chain gripper opener 1217 is preferably arranged so as to be adjustable by means of at least one drive 1224. The at least one drive 1224 is in particular arranged so as to adjust the chain gripper opener 1217 on a linear guide 1219. For example, the at least one drive 1224 is pneumatically and/or hydraulically and/or electrically driven to adjust the chain gripper opener 1217. Advantageously, the at least one drive 1224 is electrically driven, and at least one guide element 1221 is fixedly arranged on the revolving means. The at least one drive 1224 is arranged to drive the at least one revolving means. For example, the revolving means is configured as a belt and/or chain and arranged to also adjust the at least one guide element 1221. In a preferred embodiment, the at least one linear guide 1219 is arranged so as to be vertically oriented. The at least one drive 1224 is in particular functionally connected to a guide element 1221. The at least one guide element 1221 is arranged so as to be, preferably vertically, adjustable on at least one linear guide 1219. The at least one chain gripper opener 1217 is preferably arranged to be adjusted from a first position into a second position along the guide path 1230 as a result of the adjustment of the at least one guide element 1221. To carry out the equidistant adjustment of the at least one chain gripper opener 1217 on the guide 1218, in particular a conversion of the linear, preferably vertical, movement by the drive 1224 into a movement along the guide 1218 is necessary. In particular, a movement along the guide 1218 is predefined by the at least one guide element 1205 of the at least one chain gripper opener 1217. The at least one chain gripper opener 1217 is connected to at least one further guide element 1223. The at least one further guide element 1223 is in particular arranged on a further linear guide 1222. In particular, a further guide element 1223 is movably arranged on the further, preferably horizontally oriented, linear guide 1222.

In another embodiment, the at least one linear guide 1222 and the at least one linear guide 1219 are not arranged perpendicular to one another. In particular, the linear guides 1222; 1219 are, for example, arranged at an angle different from 90° with respect to one another. For example, an angle is between 45° and 90° or is a smaller angle.

More preferably, the at least one chain gripper opener 1217 is connected to the at least one drive 1224 via at least one articulated joint 1228. The at least one chain gripper opener 1217 is in particular arranged so as to be pivotable via the at least one articulated joint 1228. It is in particular pivotable in such a way that at least the opening region 1227 is adjustable so as to be equidistant with respect to the guide path 1230.

The at least one chain gripper opener 1217 is preferably arranged so as to adjustable to various modes of operation of the sheet processing machine 01, in particular the die-cutting machine 01. The at least one sheet processing machine 01, in particular the die-cutting machine 01, is preferably arranged so as to be adjustable at least as a function of the machine speed and/or the substrate properties and/or the substrate shape and/or the offcut piece format. For example, the sheet processing machine 01, in particular the die-cutting machine 01, comprises at least one memory device comprising a memory. For example, various modes of operation can be stored in and retrieved from the memory. In particular, the position of at least one chain gripper opener 1217 can be stored as a function of a machine speed and/or the substrate properties and/or the substrate shape and/or the offcut piece format. In particular, the position of the at least one chain gripper opener 1217 can be automatically adapted in the event of a change of a machine speed and/or of the substrate shape and/or of the substrate properties and/or of the offcut piece format. For example, the substrate shape and the substrate properties shall be understood to mean the thickness and/or the weight and/or the length and/or the width of the substrate 02 and/or of the sheet 02 and/or the offcut pieces 05; 06.

More preferably, in addition or as an alternative, an adjustment of the at least one chain gripper opener 1217 as a function of the offcut piece format is possible. Depending on the number of multiple-ups 03 and/or the previous processing steps and/or the format of the sheet 02, the offcut piece 05; 06 has a different configuration. For example, the offcut piece 05 is also configured with transverse crosspieces and/or longitudinal crosspieces. In particular, an adaptation of the chain gripper position can also be expanded to other changes during the machine operation.

In particular, the at least one chain gripper opener 1217 can be adjusted in a method. In particular, the at least one chain gripper opener 1217, in the method, is at least partially guided through the sheet processing machine 01 on a guide path 1230 by means of the at least one chain 1203. On a portion of the guide path 1230, the contact element 1206 of the at least one chain gripper carriage 1201 cooperates with a contact surface 1226 of the at least one chain gripper opener 1201. In particular, the at least one holding element 1202 is transferred at least from a closed position into an open position during the cooperation of the contact element 1206 with the contact surface 1226. More preferably, the at least one holding element 1202 is also transferred from the closed position into the open position while the contact element 1206 is in contact with the contact surface 1226.

The contact surface 1226 furthermore includes an opening region 1227. During the cooperation of the contact element 1206 with the opening region 1227, the at least one holding element 1201 begins to open. In particular, the opening region 1227 has the distance 1227 with respect to the guide path 1230. The opening region 1227 is in particular adjusted so as to be equidistant with respect to the guide path 1230 during the adjustment of the at least one chain gripper opener 1217.

The at least one chain gripper opener 1217 is preferably adjusted in the event of a change of the machine speed and/or in the event of a change of the substrate properties and/or of the substrate format and/or of the offcut piece format. The position of the at least one chain gripper opener 1217 is preferably adjusted as a function of the offcut piece format. For example, the offcut piece format differs in terms of the thickness and/or the width and/or the weight of the sheet 02 and/or in terms of the number of removed multiple-ups 03 and/or in terms of the distribution of the removed multiple-ups 03 of the sheet 02. The distribution and/or the number of the removed multiple-ups 03 in particular result in a different embodiment of the crosspieces 05, in particular as transverse crosspieces and/or longitudinal crosspieces.

The positions of the at least one chain gripper opener 1217 at various machine speeds and/or at various substrate formats and/or at various substrate properties and/or at various offcut piece formats are advantageously stored in a memory. The position of the chain gripper opener 1217 is adjusted based on the data stored in the memory.

In particular, the at least one chain gripper carriage 1201 is adjusted on the guide path 1230 counter to a guide direction F when the machine speed is increased. When the machine speed is decreased, the at least one chain gripper opener 1217 is preferably adjusted on the guide path 1230 in the guide direction F.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A die-cutting machine (01) comprising a transport system (1200) configured as a at least one chain gripper system (1200), the at least one chain gripper system (1200) comprising at least one chain gripper carriage (1201) comprising at least one holding element (1202) for holding a sheet (02), the at least one chain gripper carriage (1201) being arranged so as to be attached to the at least one chain (1203), at least one chain (1203) being arranged so as to guide the at least one chain gripper carriage (1201) on a guide path (1230) through at least part of the die-cutting machine (01), the at least chain gripper carriage (1201) comprising at least one contact element (1206), the at least one contact element (1206) being functionally connected to the at least one holding element (1202), the die-cutting machine (01) comprising at least one chain gripper opener (1217), the at least one chain gripper opener (1217) including at least one contact surface (1226) at which, in the presence of the at least one gripper carriage (1201) at the at least one contact surface (1226), the at least one contact element (1206) of the at least one chain gripper carriage (1201) is arranged so as to cooperate with the at least one chain gripper opener (1217), the at least one holding element (1202) being arranged to be transferred at least from a closed position into an open position by way of the cooperation of the at least one chain gripper opener (1217) with the at least one contact element (1206), the at least one chain gripper opener (1217) being arranged so as to be adjustable by means of at least one drive (1224), the at least one drive (1224) being arranged so as to adjust the at least one chain gripper opener (1217) on a linear guide (1219), and the at least one contact surface (1226) comprising at least one opening region (1227) at which the at least one holding element (1202) is arranged to start a transfer from a closed position into an open position, characterized in that the at least one chain gripper opener (1217) is arranged so as to be adjustable curvilinearly along a curved section of the guide path (1230) by curvilinear adjustment of the at least one chain gripper opener (1217) along a curved guide (1218) by way of the at least one drive (1224) and the linear guide (1219), and that the at least one opening region (1227) has a distance (L1227) with respect to the guide path (1230), and that the at least one opening region (1227) is adjustable so as to be equidistant with respect to the guide path (1230) by the curvilinear adjustment of the at least one chain gripper opener (1217) along the curved guide (1218).

2. The die-cutting machine according to claim 1, characterized in that the at least one drive (1224) is arranged so as to pneumatically and/or hydraulically and/or electrically drive the at least one chain gripper opener (1217).

3. The die-cutting machine according to claim 1, characterized in that the distance (L1227) between the at least one opening region (1227) and the guide path (1230) in the case of an equidistant adjustment is arranged so as to vary by less than 10%.

4. The die-cutting machine according to claim 1, characterized in that the at least one chain gripper opener (1217) is arranged so as to be adjustable along the curved guide (1218) by way of the at least one drive (1224), the linear guide (1219), and another linear guide (1222).

5. The die-cutting machine according to claim 1, characterized in that the at least one chain gripper opener (1217) comprises at least one guide element (1221), and that the at least one guide element (1221) is arranged to run in the linear guide (1219).

6. The die-cutting machine according to claim 1, characterized in that the at least one chain gripper opener (1217) is connected to the at least one drive (1224) via at least one articulated joint (1228).

7. The die-cutting machine according to claim 5, characterized in that the at least one drive (1224) is functionally connected to the at least one guide element (1221), and that the at least one guide element (1221) is arranged so as to be adjustable on the linear guide (1219).

8. The die-cutting machine according to claim 1, characterized in that the at least one chain gripper opener (1217) is arranged so as to be adjustable as a function of at least one of machine speed, substrate properties, or substrate format.

9. A method for opening at least one holding element (1202) in a sheet processing machine (01) configured as a die-cutting machine (01), the die-cutting machine (01) comprising a transport system (1200) configured as a chain gripper system (1200), for transporting sheets (02) through at least part of the die-cutting machine (01), and at least one chain gripper carriage (1201) of the chain gripper system (1200) being attached to at least one chain (1203), the at least one chain gripper carriage (1201) being at least partially guided on a guide path (1230) through the die-cutting machine (01) by means of the at least one chain (1203), at least one contact element (1206) of the at least one chain gripper carriage (1201) cooperating on a portion of the guide path (1230) with at least one contact surface (1226) of at least one chain gripper opener (1217), and the at least one holding element (1202) being transferred at least from a closed position into an open position during the cooperation of the at least one contact element (1206) with the at least one contact surface (1226) of the at least one chain gripper opener (1217), the at least one chain gripper opener (1217) being adjustable by means of at least one drive (1224), the at least one drive (1224) adjusting the at least one chain gripper opener (1217) on a linear guide (1219), the at least one contact surface (1226) including an opening region (1227), and the at least one holding element (1202) beginning to open during the cooperation of the at least one contact element (1206) with the opening region (1227), characterized in that the at least one chain gripper opener (1217) can be adjusted curvilinearly along a curved section of the guide path (1230) by curvilinear adjustment of the at least one chain gripper opener (1217) along a curved guide (1218) by means of the at least one drive (1224) and the linear guide (1219), and that the at least one opening region (1227) is adjusted so as to be equidistant with respect to the guide path (1230) by the curvilinear adjustment of the at least one chain gripper opener (1217) along the curved guide (1218).

10. The method according to claim 9, characterized in that the at least one drive (1224) pneumatically and/or hydraulically and/or electrically drives the at least one chain gripper opener (1217).

11. The method according to claim 9, characterized in that the at least one opening region (1227) has a distance (L1227) with respect to the guide path (1230).

12. The method according to claim 9, characterized in that the at least one chain gripper opener (1217) is adjusted based on at least one of a change of machine speed, a change of substrate properties, or a change of substrate format.

13. The method according to claim 9, characterized in that positions of the at least one chain gripper opener (1217) at various machine speeds or at various formats or at various substrate properties are stored in a memory, and that the position of the chain gripper opener (1217) is adjusted based on data stored in the memory.

14. The method according to claim 9, characterized in that the at least one chain gripper opener (1217) is adjusted along the guide path (1230) counter to a guide direction (F) when a machine speed is increased.

15. The method according to claim 9, characterized in that the at least one chain gripper opener (1217) is adjusted along the guide path (1230) in a guide direction (F) when a machine speed is decreased.

* * * * *